United States Patent [19]

Enomoto et al.

[11] 4,161,404

[45] Jul. 17, 1979

[54] PHOTOSENSITIVE MATERIAL FOR USE IN ELECTROPHOTOGRAPHY WITH A POLY ALKYL OR BENZYL GLUTAMATE

[75] Inventors: Takamichi Enomoto; Seiiti Sakuma, both of Tokyo, Japan

[73] Assignee: Ricoh Co., Ltd., Tokyo, Japan

[21] Appl. No.: 840,276

[22] Filed: Oct. 7, 1977

[30] Foreign Application Priority Data

Oct. 13, 1976 [JP] Japan ..... 51-122661

[51] Int. Cl.[2] ..... G03G 5/14

[52] U.S. Cl. ..... 96/1.5 R; 96/1.8

[58] Field of Search ..... 96/1 R, 1 C, 1.5, 1.8

[56] References Cited

U.S. PATENT DOCUMENTS

| | | | |
|---|---|---|---|
| 3,682,632 | 8/1972 | Arai et al. | 96/1.5 |
| 3,700,449 | 10/1972 | Lerner | 96/1.5 |
| 3,704,122 | 11/1972 | Yamaguchi et al. | 96/1.5 |
| 3,791,826 | 2/1974 | Cherry et al. | 96/1.5 |
| 3,839,033 | 10/1974 | Matsumo et al. | 96/1.5 |
| 3,933,492 | 1/1976 | Maruyama et al. | 96/1.5 |

*Primary Examiner*—Roland E. Martin, Jr.
*Assistant Examiner*—John L. Goodrow
*Attorney, Agent, or Firm*—Blanchard, Flynn, Thiel, Boutell & Tanis

[57] ABSTRACT

The present invention provides a photosensitive material for use in electrophotography which is prepared by forming a barrier layer containing a peptide polymer between a conductive support and a photosensitive layer. This photosensitive material impedes unnecessary charge infiltration through the conductive support, maintains an appropriate charge acceptability, imparts an adhesive property of the photosensitive layer in relation to the support or flexibility of the photosensitive material, and prevents deterioration of such characteristics as photosensitivity, residual potential, etc. When some acceptor or donor is additionally mixed in said barrier layer, the electrification property thereof is improved.

11 Claims, No Drawings

PHOTOSENSITIVE MATERIAL FOR USE IN ELECTROPHOTOGRAPHY WITH A POLY ALKYL OR BENZYL GLUTAMATE

BACKGROUND OF THE INVENTION

1. Field of the Invention

The present invention relates to an improved photosensitive material for use in electrophotography which is prepared by forming a barrier layer and a photosensitive layer, in that order, on a conductive support.

2. Description of the Prior Art

Generally speaking, in the case of photosensitive materials prepared by dispersing pigments in a resinous binder, there is observed, more or less, a tendency that it becomes hard to charge them with electricity or to increase their potential holdability in the dark (dark decay) gradually as a result of repetition of the electrification-exposure operation. Such changes in characteristics of photosensitive materials would have a very bad effect at the time of taking numerous copies in a PPC-type copying system. Therefore, as an attempt to eliminate the foregoing bad effect, the provision of a barrier layer containing some organic substance and/or inorganic substance interposed between a conductive support and a photosensitive layer has been tried.

The primary object of this barrier layer is to prevent infiltration of unnecessary electric charge through the conductive support and to maintain an appropriate charge acceptability. Another object of this barrier layer is to impart an adhesive property to the photosensitive layer in relation to the support or flexibility to the photosensitive material as a whole. Accordingly, the material constituting the barrier layer is required to combine functions sufficient for realizing both objects and, at the same time, it should not degenerate other characteristics (such as photosensitivity, residual potential, etc.). And, in order to form a photosensitive layer on this barrier layer, the method of coating with a photosensitive layer-forming liquid is usually employed. On this occasion, however, the barrier layer is apt to be dissolved by the solvent contained in said photosensitive layer-forming liquid and the barrier layer tends to commingle with the photosensitive layer. Since it is conceivable that this phenomenon may cause infiltration of unnecessary electric charge into the barrier layer and decrease the electric charge acceptability thereof, thereby rendering it impossible to achieve the primary object of the barrier layer, it becomes necessary to make the coating film of the barrier layer thicker. However, thickening of the coating film of the barrier layer will result a decrease in the electric charge acceptability and an increase in the residual potential.

SUMMARY OF THE INVENTION

The present invention is intended to provide an electrophotographic sensitive material which comprises a barrier layer capable of manifesting the essential functions of barrier layers without impairing such characteristics as photosensitivity, residual potential, etc. As a prerequisite to forming such a barrier layer, the substance for use therein should be a resin which will meet the requirements that it must be hard to dissolve in the solvent contained in the photosensitive layer-forming liquid, it can be formed in a uniform coating film having a moderate thickness (to wit, less than $2\mu$) and it can improve the charge holdability as well as the adhesive property.

The present invention employs peptide polymer as the resin to constitute the barrier layer. And, to cite applicable peptide polymers, there are polypeptides such as poly-$\gamma$-methyl glutamate, poly-$\gamma$-ethyl glutamate, poly-$\gamma$-benzyl glutamate, polybenzyl aspartate, polylysine, etc., copolymerized peptides and partially modified polypeptides, among which poly-$\gamma$-alkyl glutamate and poly-$\gamma$-benzyl glutamate are effective and particularly poly-$\gamma$-methyl glutamate is desirable. These peptide polymers have hydrogen bonds in molecule thereof, and are considered to have electric charge infiltrativity as well as mobility to some degree. In the case where the peptide polymer is employed, the thickness of barrier the layer can be in the range of $0.1$–$0.2\mu$, and even when the thickness of the barrier layer is in the range of $1$–$2\mu$, there is observed no phenomenon of increase in residual potential.

Further, in order to enhance the electrification characteristic and the photosensitive characteristic through repetition of the electrification-exposure operation, some donor or acceptor can be added to the barrier layer. Donors and acceptors are generally possessed of the properties of moving the carrier generated by application of light, and such properties seem to contribute to the improvement of the electrification characteristic. Addition of donors and acceptors in large quantities like in the case of conventional laminate type photosensitive materials would rather deteriorate the characteristics of the barrier layer, resulting in the lowering of the functions of the barrier layer formed thereof. Therefore, the optimum quantity of donors and acceptors to be added is less than 15 wt.%, preferably less than 5 wt.%, relative to the peptide polymer forming the barrier layer.

As applicable donors, there can be cited bis (diethylaminophenyl) oxadiazole, anthracene, N-ethyl carbazole, pyrene, aminoalkyl, etc., and as applicable acceptors, there can be cited nitro derivatives of aromatic compounds, chloroanil, bromoanil, 2,4,7-trinitro-9-fluorenone, 2,4,5,7-tetranitro-9-fluorenone, tetracyanopyrene, dinitroanthracene, trinitroindenothiophene, trinitroindenoquinoxaline, tetracyanoethylene, tetracyanoquinodimethane, etc. It will do to select one kind or more than two of these donors or acceptors appropriately and add it to the peptide polymer employed.

In the present invention, as the conductive support and photosensitive layer, any of those applicable to the conventional photosensitive materials can be applied. However, particularly in the case where the photosensitive layer applied is of the type composed of a resin containing photoconductive particles dispersed therein, the characteristics of the barrier layer in the present invention will be much more demonstrated.

A barrier layer comprising the peptide polymer as the main constituent is hard to dissolve in the solvent contained in the photosensitive layer-forming liquid, such as tetrahydrofuran, toluene, etc., and accordingly, it can maintain the intrinsic functions of the barrier layer without impairing the characteristics thereof as photosensitive material.

As the photoconductive substance for use in the photosensitive layer, there can be cited inorganic semi-conductors such as, for instance, zinc oxide, titanium oxide, cadmium sulfide, etc. and film-forming organic semiconductors such as, for instance, poly-N-carbazole, poly-N-vinyl-3,6-dibromocarbazole, pyreneformaldehyde resin, polyvinyl dibenzothiophene, polyvinyl anthracene, etc. In the case of using an inorganic semi-conductor, a substance which can be used independently, such as selenium, can be used jointly with a resinous binder like in the case of cadmium sulfide and zinc oxide. As the resin for this purpose, those resins which are applied to general inorganic semi-conductor-resin dispersion type photosensitive layers, such as acrylic resin, silicone resin, alkyd resin, epoxide resin, styrene-butadiene resin, melamine resin, etc., will do. Further, for the photosensitive layer, addition of some sensitizers which are generally used in electrophotography, e.g., some dye such as Rose Bengal, fluorescene, etc. in the case of employing zinc oxide, some dye such as Methylene Blue, Benzopyrylium, etc. or some acceptor such as 2,4,7-polynitrofluorenone, etc. in the case of employing organic semi-conductor, and doping with tellurium in the case of employing selenium, are allowed.

DESCRIPTION OF THE PREFERRED EMBODIMENTS

EXAMPLE 1

After preparing a 1 wt.% 1,2-dichloroethane solution of poly-γ-methyl-D-glutamate (hereinafter called PMDG for short) and coating it by means of a doctor blade on a Mylar film deposited with aluminum through vacuum evaporation, said film was subjected to 2 minutes' drying at 50° C. whereby a barrier layer of about 1.0μ in thickness was formed thereon.

Next, by coating a photosensitive liquid prepared by dispersing β-copper phthalocyanine in styrene-butadiene copolymer resin (solvent: toluene) on the foregoing barrier layer by means of a doctor blade and drying thereafter, a photosensitive layer of about 10μ in thickness was formed.

EXAMPLE 2

To the PMDG-containing solution employed in Example 1 was further added bisdiaminophenyl-1,3,6-oxadiazole (hereinafter called OXD for short) to the extent of 1–3 wt.% relative to the solid content of PMDG. By applying the same procedures as in Example 1 subsequent thereto, a barrier layer of about 1.5–2.0μ in thickness and a photosensitive layer of about 10μ in thickness were formed.

EXAMPLE 3

By applying the same procedures as in Example 2 except for employing 2 wt.% of 2,4,7-trinitro-9-fluorenone (hereinafter called TNF for short) in lieu of OXD, a photosensitive material was formed.

EXAMPLE 4

By applying the same procedures as in Example 1 except for employing 1.0 wt% of poly-γ-benzyl-L-glutamate (hereinafter called PBLG for short) in lieu of PMDG, a photosensitive material was formed.

All of the barrier layers formed in the foregoing Examples 1–4 were hard to dissolve in organic solvents such as tetrahydrofuran, toluene, etc.

When the electrostatic properties of the foregoing photosensitive materials were measured by means of a paper analyzer, the results were as shown in the following table.

| | Construction of barrier layer | Thickness of barrier layer (μ) | Dark decay[1] | Change in dark decay due to repeated operation[2] (5 times) | Change in sensitivity due to addition of OXD, TNF[3] |
|---|---|---|---|---|---|
| Comparative Example | no barrier layer | — | 0.51 | 0.28 | — |
| Example 1 | PMDG | 1.0 | 0.65 | 0.58 | 1 |
| | PMDG+1wt. % OXD | 1.5 | 0.69 | 0.64 | 0.88 |
| Example 2 | PMDG+2wt. % OXD | 1.9 | 0.67 | 0.61 | 0.72 |
| | PMDG+3wt. % OXD | 2.0 | 0.68 | 0.60 | 0.64 |
| Example 3 | PMDG+2wt. % TNF | 1.4 | 0.63 | 0.50 | 0.82 |
| Example 4 | PBLG | 1.0 | 0.64 | 0.59 | — |

(Remarks)
[1]The ratio (Vo/Vs) of the charged potential of photosensitive material (Vs) after charging with +6.0KV for 20 seconds to the charged potential (Vo) at the time when said photosensitive material was left standing for 20 seconds in the dark subsequent thereto.
[2]Change in the dark decay when the operation comprising electrification (for 20 seconds), leaving standing in the dark (for 20 seconds), exposure (for 30 seconds) and forced exposure (for 10 seconds) in order was repeated 5 times.
[3]The relative value of each sample when the time of exposure required for half decay of PMDG-containing barrier layer was set as 1.

Besides, the endurable frequency of operation was also improved from about 3000 times (in Comparative Example) to more than 10000 times (in Examples 1–4), and when subjected to developing with a dry developer, they could produce an image having an excellent reproducibility. Moreover, by virtue of the provision of a barrier layer, the adhesive property was improved, and there was observed no occurrence of cracking due to bending.

What is claimed is:

1. In a photosensitive material for use in electrophotography comprising an electrically conductive support, a barrier layer on said support and a photosensitive layer on said barrier layer, the improvement which comprises: said barrier layer consists essentially of a polymer selected from the group consisting of film-forming poly-γ-alkyl glutamate and film-forming poly-γ-benzyl glutamate.

2. A photosensitive material according to claim 1 in which said polymer is poly-γ-methyl glutamate.

3. A photosensitive material according to claim 1 in which said polymer is poly-γ-ethyl glutamate.

4. A photosensitive material for use in electrophotography according to claim 1, wherein said polymer is poly-γ-benzyl glutamate.

5. A photosensitive material for use in electrophotography according to claim 1, wherein said barrier layer has a thickness in the range of 0.1–2μ.

6. In a photosensitive material for use in electrophotography comprising an electrically conductive support, a barrier layer on said support and a photosensitive layer on said barrier layer, the improvement which comprises: said barrier layer consists essentially of a mixture of a polymer selected from the group consisting of film-forming poly-γ-alkyl glutamate and film-forming poly-γ-benzyl glutamate, and up to less than 15 wt.%, based on the weight of said polymer, of an electron donor or acceptor for electrophotography.

7. A photosensitive material according to claim 6 in which said polymer is poly-γ-methyl glutamate.

8. A photosensitive material according to claim 6 in which said polymer is poly-γ-ethyl glutamate.

9. A photosensitive material according to claim 6 in which said polymer is poly-γ-benzyl glutamate.

10. A photosensitive material according to claim 6 wherein said barrier layer has a thickness in the range of 0.1 to 2μ.

11. A photosensitive material according to claim 6 in which said donor is selected from the group consisting of bis(diethylaminophenyl)oxadiazole, anthracene, N-ethyl carbazole and pyrene, and said acceptor is selected from the group consisting of chloroanil, bromoanil, 2,4,7-trinitro-9-fluorenone, 2,4,5,7-tetranitro-9-fluorenone, tetracyanopyrene, dinitroanthracene, trinitroindenothiophene, trinitroindenoquinoxaline, tetracyanoethylene and tetracyanoquinodimethane.

* * * * *